US008956010B2

(12) United States Patent
Huang

(10) Patent No.: US 8,956,010 B2
(45) Date of Patent: Feb. 17, 2015

(54) DIFFUSING LENS AND PLANAR LIGHT SOURCE HAVING DIFFUSING LENS TO INCREASE LIGHT UNIFORMITY

(71) Applicant: Hon Hai Precision Industry Co., Ltd., New Taipei (TW)

(72) Inventor: Yung-Lun Huang, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 46 days.

(21) Appl. No.: 13/925,251

(22) Filed: Jun. 24, 2013

(65) Prior Publication Data

US 2014/0211469 A1 Jul. 31, 2014

(30) Foreign Application Priority Data

Jan. 31, 2013 (TW) ..... 102103709 A

(51) Int. Cl.
*F21V 5/00* (2006.01)

(52) U.S. Cl.
CPC ..... *F21V 5/007* (2013.01)
USPC ..... 362/246; 362/235; 362/237; 362/249.02; 362/311.02; 257/98; 257/99; 257/100; 257/40; 359/636; 359/742; 359/726

(58) Field of Classification Search
USPC ..... 362/246, 235, 237, 249.02, 311.02; 257/98, 99, 100, 40; 359/636, 742, 726
See application file for complete search history.

(56) References Cited

U.S. PATENT DOCUMENTS

| | | | | |
|---|---|---|---|---|
| 7,344,902 | B2 * | 3/2008 | Basin et al. | 438/27 |
| 7,352,011 | B2 * | 4/2008 | Smits et al. | 257/99 |
| 7,422,347 | B2 * | 9/2008 | Miyairi et al. | 362/335 |
| 8,585,254 | B2 * | 11/2013 | Arai et al. | 362/317 |
| 2002/0141006 | A1 * | 10/2002 | Pocius et al. | 359/15 |
| 2003/0007359 | A1 * | 1/2003 | Sugawara et al. | 362/326 |
| 2005/0162750 | A1 * | 7/2005 | Kittelmann et al. | 359/636 |
| 2005/0286145 | A1 * | 12/2005 | Silhengst et al. | 359/742 |
| 2006/0044806 | A1 * | 3/2006 | Abramov et al. | 362/337 |
| 2006/0105485 | A1 * | 5/2006 | Basin et al. | 438/27 |
| 2006/0152931 | A1 * | 7/2006 | Holman | 362/297 |
| 2007/0047401 | A1 * | 3/2007 | Sun | 369/44.23 |
| 2007/0053275 | A1 * | 3/2007 | Sun | 369/112.24 |
| 2007/0064423 | A1 * | 3/2007 | Shimura | 362/231 |
| 2007/0091770 | A1 * | 4/2007 | Sun | 369/112.24 |
| 2008/0157110 | A1 * | 7/2008 | Huang et al. | 257/98 |
| 2009/0279311 | A1 * | 11/2009 | Yu et al. | 362/310 |
| 2010/0061105 | A1 * | 3/2010 | Shyu et al. | 362/311.02 |
| 2010/0061106 | A1 * | 3/2010 | Shyu et al. | 362/311.02 |
| 2012/0119657 | A1 * | 5/2012 | Snijder et al. | 315/149 |
| 2012/0126268 | A1 * | 5/2012 | Seo et al. | 257/98 |
| 2014/0085738 | A1 * | 3/2014 | Qian et al. | 359/726 |

* cited by examiner

*Primary Examiner* — Thomas A Hollweg
(74) *Attorney, Agent, or Firm* — Novak Druce Connolly Bove + Quigg LLP

(57) ABSTRACT

A diffusing lens includes a first surface and a second surface facing away from the first surface. The first surface has a first negative Fresnel structure for diffusing light from a point light source. The second surface has a second negative Fresnel structure aligning with the first negative Fresnel structure and for further diffusing the light of the point light source.

14 Claims, 3 Drawing Sheets

DIFFUSING LENS AND PLANAR LIGHT SOURCE HAVING DIFFUSING LENS TO INCREASE LIGHT UNIFORMITY

BACKGROUND

1. Technical Field

The present disclosure relates to light sources and, more particularly, to a diffusing lens and a planar light source having the diffusing lens to increase light uniformity.

2. Description of Related Art

Light emitting diodes are used in displays as light sources. However, the light emitting diode is a point light source and has an excellent directionality while the display have a large-size screen and thus requires a large-size planar light source. As such, the light emitting diodes are arrayed and light emitted from each light emitting diode subjects to diffusion and homogenization by a diffusing lens having two concave surfaces. To efficiently diffuse and homogenize the light, curvatures of the concave surfaces should be sufficient large. However, it is difficult to mold a large-curvature concave surface.

Therefore, it is desirable to provide a diffusing lens and a planar light source, which can overcome the above-mentioned problems.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure.

DETAILED DESCRIPTION

Embodiments of the present disclosure will be described with reference to the drawings.

Figure 1:
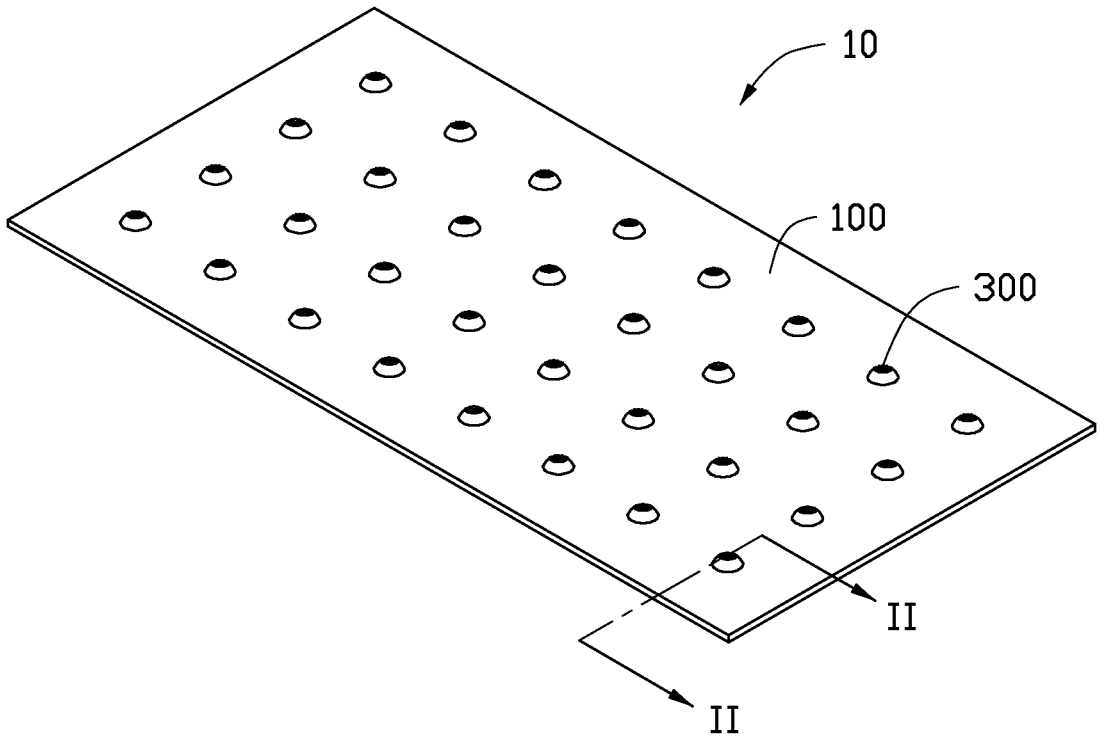
FIG. 1 is an isometric schematic view of a planar light source, according to an embodiment.
Figure 2:
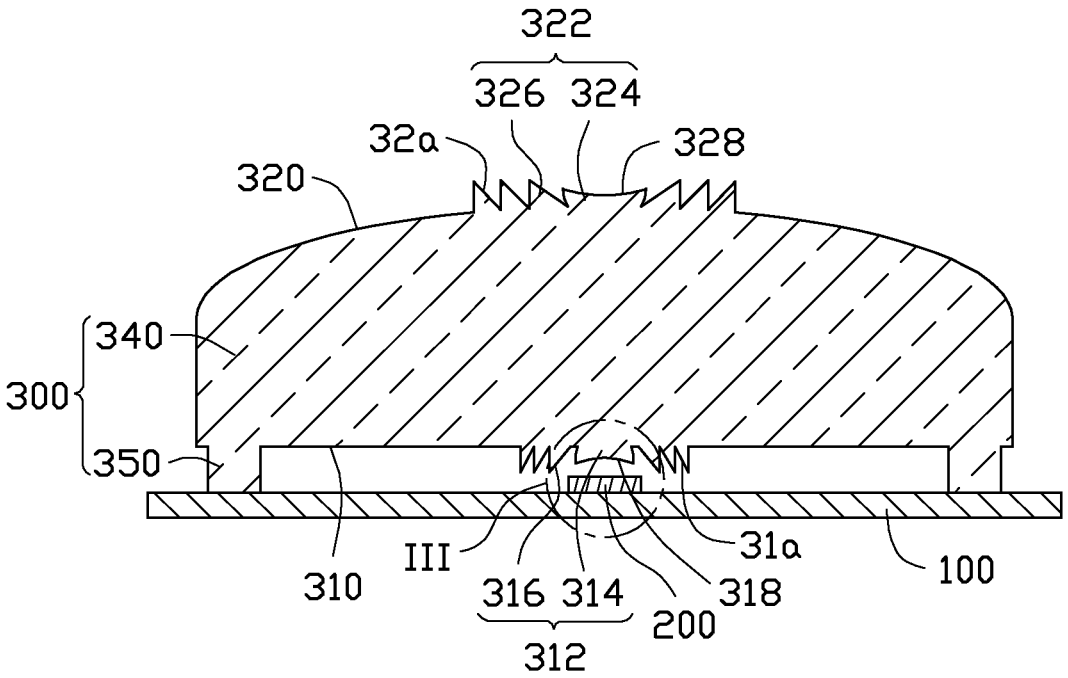
FIG. 2 is a cross-sectional view taken along a line II-II of FIG. 1.

FIGS. 1 and 2 show a planar light source 10 according to an embodiment. The planar light source 10 includes a substrate 100, an array of point light sources 200, such as light emitting diodes, positioned on the substrate 100, and an array of diffusing lenses 300 positioned on the substrate 100. Each diffusing lens 300 covers a corresponding one of the point light sources 200 and includes a first surface 310 facing the corresponding point light source 200 and a second surface 320 facing away from the first surface 310. The first surface 310 has a first negative Fresnel structure 312 aligning with the corresponding point light source 200. The second surface 210 has a second negative Fresnel structure 322 aligning with the first negative Fresnel structure 312.

As such, light emitting from each point light source 200 can be efficiently diffused and homogenized by the first negative Fresnel structure 312 and the second negative Fresnel 322. As such, curvatures of the first surface 310 and the second surface 320 can be reduced and even employ a flat surface, to facilitate molding of the diffusing lenses 300.

The substrate 100 is a printed circuit board and is connected to the point light sources 200 to drive and control the point light sources 200.

In this embodiment, the first surface 310 is a flat surface, and the second surface 320 can be a convex surface of a relative small curvature, to facilitate the molding of the diffusing lenses 300. In this manner, a height of each diffusing lens 300 is efficiently reduced, facilitating miniaturization of the planar light source 10.

Each diffusing lens 300 includes a lens body 340 and an annular supporting portion 350. The lens body 340 has the first surface 310 and the second surface 320. The supporting portion 350 extends downward from an outer periphery of the first surface 310 and surrounds the first negative Fresnel structure 312. The support portion 350 is configured to support the lens body 340 above the corresponding point light source 200 such that the point light source 200 is essentially located at a focal plane of the first negative Fresnel structure 312.

The first negative Fresnel structure 312 is located generally at a center of the first surface 310 and includes a first central section 314 and a number of first ring sections 316 concentrically surrounding the first central section 314. The first central section 314 includes a first central surface 318 directly facing the corresponding point light source 200. Each first ring section 316 includes a first side surface 31*a* facing the corresponding point light source 200. The first central surface 318 and the first side surfaces 31*a*, when connected with each other, constitute a lens surface of a relative large curvature.

The second negative Fresnel structure 322 is located generally at a center of the second surface 320 and includes a second central section 324 aligning with the first central section 314 and a number of second ring sections 326 concentrically surrounding the second central section 324. The second central section 324 includes a second central surface 328 facing away from the corresponding point light source 200. Each second ring section 326 includes a second side surface 32*a* facing away from the corresponding point light source 200. The second central surface 328 and the second side surfaces 32*a*, when connected with each other, constitute a lens surface of a relative large curvature.

Figure 3:
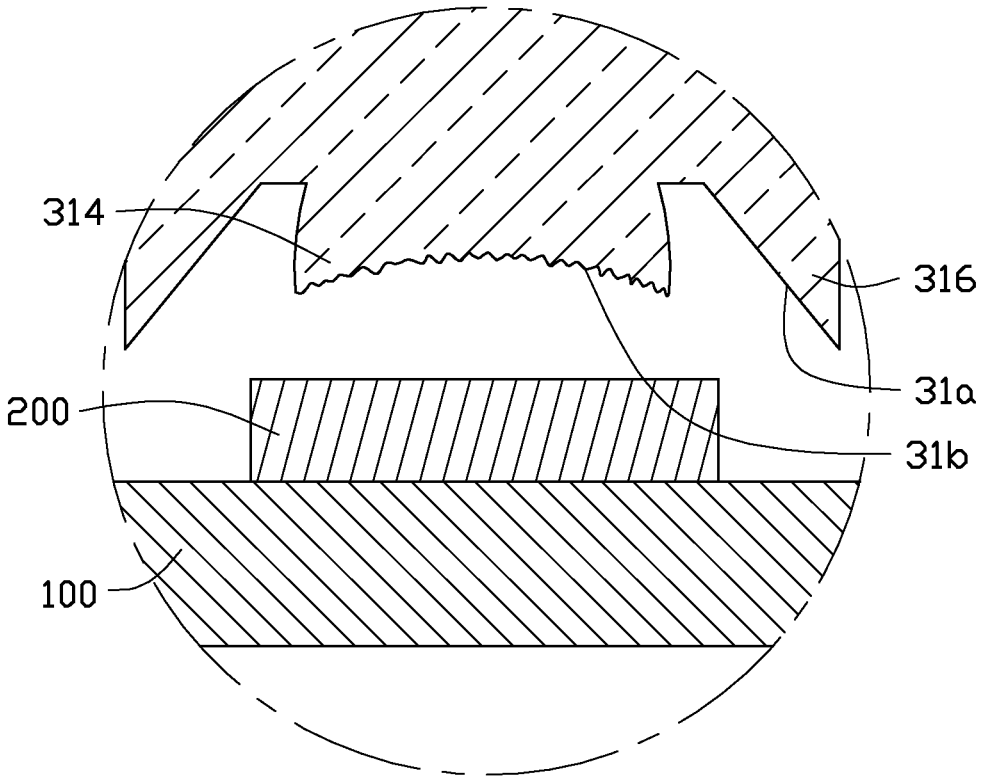
FIG. 3 is an enlarged view of a circled portion III of FIG. 2.

FIG. 3 shows that the first central surface 318 is formed with microstructures 31*b* to further diffuse a part of the passing light as the light is more concentrated at in this part and may form a spot if the microstructures 31 are not employed. The microstructures 31*b* can be formed by sandblasting.

It will be understood that the above particular embodiments are shown and described by way of illustration only. The principles and the features of the present disclosure may be employed in various and numerous embodiments thereof without departing from the scope of the disclosure. The above-described embodiments illustrate the possible scope of the disclosure but do not restrict the scope of the disclosure.

What is claimed is:

1. A planar light source, comprising:

a substrate;

an array of point light sources positioned on the substrate; and an array of diffusing lenses positioned on the substrate, each diffusing lens covering a corresponding one of the point light sources and comprising a first surface facing the corresponding point light source and a second surface facing away from the first surface; the first surface having a first negative Fresnel structure aligning with the corresponding point light source, the second surface having a second negative Fresnel structure aligning with the first negative Fresnel structure.

2. The planar light source of claim 1, wherein the substrate is a printed circuit board and is connected to the point light sources to drive and control the point light sources.

3. The planar light source of claim 1, wherein the point light sources are light emitting diodes.

4. The planar light source of claim 1, wherein the first surface is a flat surface, and the second surface is a convex surface.

5. The planar light source of claim 1, wherein each diffusing lens comprises a lens body and an annular supporting portion, the lens body has the first surface and the second surface, the supporting portion extends downward from an outer periphery of the first surface and surrounds the first negative Fresnel structure, and the support portion is configured to support the lens body above the corresponding point light source such that the corresponding point light source is essentially located at a focal plane of the first negative Fresnel structure.

6. The planar light source of claim 1, wherein the first negative Fresnel structure is located generally at a center of the first surface and comprises a first central section and a plurality of first ring sections concentrically surrounding the first central section, the first central section comprises a first central surface directly facing the corresponding point light source, and each first ring section comprises a first side surface facing the corresponding point light source.

7. The planar light source of claim 6, wherein the first central surface is formed with microstructures.

8. The planar light source of claim 1, wherein the second negative Fresnel structure is located generally at a center of the second surface and comprises a second central section aligning with the first central section and a plurality of second ring sections concentrically surrounding the second central section, the second central section comprises a second central surface facing away from the corresponding point light source, and each second ring section comprises a second side surface facing away from the corresponding point light source.

9. A diffusing lens, comprising:

a first surface having a first negative Fresnel structure for diffusing light from a point light source; and a second surface facing away from the first surface and having a second negative Fresnel structure aligning with the first negative Fresnel structure and for further diffusing the light of the point light source.

10. The diffusing lens of claim 9, wherein the first surface is a flat surface, and the second surface is a convex surface.

11. The diffusing lens of claim 9, wherein each diffusing lens comprises a lens body and an annular supporting portion, the lens body has the first surface and the second surface, the supporting portion extends downward from an outer periphery of the first surface and surrounds the first negative Fresnel structure, and the support portion is configured to support the lens body above the point light source such that the point light source is essentially located at a focal plane of the first negative Fresnel structure.

12. The diffusing lens of claim 9, wherein the first negative Fresnel structure is located generally at a center of the first surface and comprises a first central section and a plurality of first ring sections concentrically surrounding the first central section, the first central section comprises a first central surface for directly facing the point light source, and each first ring section comprises a first side surface for facing the point light source.

13. The diffusing lens of claim 12, wherein the first central surface is formed with microstructures.

14. The diffusing lens of claim 9, wherein the second negative Fresnel structure is located generally at a center of the second surface and comprises a second central section aligning with the first central section and a plurality of second ring sections concentrically surrounding the second central section, the second central section comprises a second central surface for facing away from the point light source, and each second ring section comprises a second side surface for facing away from the point light source.

* * * * *